US006198090B1

(12) United States Patent
Iosue

(10) Patent No.: US 6,198,090 B1
(45) Date of Patent: Mar. 6, 2001

(54) NIGHT VISION DEVICE AND METHOD

(75) Inventor: Michael Jude Iosue, Phoenix, AZ (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/237,492

(22) Filed: Jan. 25, 1999

(51) Int. Cl.[7] ..... H01J 31/50

(52) U.S. Cl. ..... 250/214 VT; 313/103 CM; 313/105 CM; 313/524

(58) Field of Search ..... 250/214 VT, 207; 313/103 CM, 105 CM, 524, 525, 526, 527, 528, 532; 445/53

(56) References Cited

U.S. PATENT DOCUMENTS 4,142,101 * 2/1979 Yin ..... 250/214 VT
4,978,885 * 12/1990 White et al. ..... 313/103 CM
5,883,380 * 3/1999 Sinor ..... 250/214 VT

* cited by examiner

*Primary Examiner*—John R. Lee
*Assistant Examiner*—Kevin Pyo
(74) *Attorney, Agent, or Firm*—Marsteller & Associates, P.C.

(57) ABSTRACT

A night vision device (10) with an image intensifier tube (14) includes an improved microchannel plate (22) which has an extraordinarily low indigenous population of gas molecules. Because of this low population of gas molecules, positive ions produced from these gas molecules in the high voltage operating environment of the image intensifier tube (14) are of such a low number that the image intensifier tube (14) will operate for a satisfactory service life even though the microchannel plate (22) has no ion barrier film. The microchannel plate (22) is also spaced much closer to a photocathode (20) of the image intensifier tube (14) than has heretofore been possible. Thus, improved gain and reduction or elimination of image halo also results from the present invention.

26 Claims, 4 Drawing Sheets

64
66
66a
66b
66c
70
72
74
PUMP
76
78
78a
78b
80
80a
80b
Cs
82
84
Q
52
20
68
100
102
104
104a
104b
108
108a
110
24
86
88
88a
88b
90
98

NIGHT VISION DEVICE AND METHOD

BACKGROUND OF THE INVENTION

1. Field of the Invention

The present invention is generally in the field of night vision devices (NVD's) of the light-amplification type. Such NVD's employ an image intensifier tube ($I^2T$) to receive photons of light from a scene. This scene may be illuminated by full day light; or alternatively, the scene may be illuminated with light which is either of such a low level, or of such a long wavelength (i.e., infrared light), or both, that the scene is only dimly visible or is effectively invisible to the natural human vision. The $I^2T$ responsively provides a visible image replicating the scene.

2. Related Technology

Even on a night which is too dark for natural human vision, invisible infrared light is richly provided in the near-infrared portion of the spectrum by the stars of the night sky. Human vision cannot utilize this infrared light from the stars because the infrared portion of the spectrum is invisible for humans. Under such conditions, a night vision device (NVD) of the light amplification type can provide a visible image replicating a night-time scene. Such NVD's generally include an objective lens which focuses invisible infrared light from the night-time scene through the transparent light-receiving face of an image intensifier tube ($I^2T$). At its opposite image-output face, the $I^2T$ provides a visible image, generally in yellow-green phosphorescent light. This image is then presented via an eyepiece lens to a user of the device.

A contemporary NVD will generally use an $I^2T$ with a photocathode (PC) behind the light-receiving face of the tube. The PC is responsive to photons of visible and infrared light to liberate photoelectrons. Because an image of a night-time scene is focused on the PC, photoelectrons are liberated from the PC in a pattern which replicates the scene. These photoelectrons arc moved by a prevailing electrostatic field to a microchannel plate having a great multitude of microchannels, each of which is effectively a dynode. These microchannels have an interior surface substantially defined by a material providing a high average emissivity of secondary electrons. In other words, each time an electron (whether a photoelectron or an electron previously emitted by the microchannel plate) collides with this material at the interior surface of the microchannels, more than one electron (i.e., secondary-emission electrons) leaves the site of the collision. This process of secondary electron emissions is not an absolute in each case, but is a statistical process having an average emissivity of greater than unity.

As a consequence, the photoelectrons entering the microchannels cause a geometric cascade of secondary-emission electrons moving along the microchannels, from one face to the other so that a spatial output pattern of electrons (which replicates the input pattern; but at a considerably higher electron density) issues from the microchannel plate.

This pattern of electrons is moved from the microchannel plate to a phosphorescent screen electrode by another electrostatic field. When the electron shower from the microchannel plate impacts on and is absorbed by the phosphorescent screen electrode, a visible image is produced. This visible image is passed out of the tube through a transparent image-output window for viewing.

The necessary electrostatic fields for operation of an $I^2T$ are provided by an electronic power supply. Usually a battery provides the electrical power to operate this electronic power supply so that many of the conventional NVD's are portable.

However, the electrostatic fields maintained within a conventional image intensifier tube, and which are effective to move electrons from the photocathode to the screen electrode, also unavoidably move any positive ions which exist within the image intensifier tube toward the photocathode. Because such positive ions may include the nucleus of gas atoms of considerable size (i.e., of hydrogen, oxygen, and nitrogen, for example, all of which are much more massive than an electron), these positive gas ions are able to impact upon and cause physical and chemical damage to the photocathode.

Conventional image intensifier tubes have an unfortunately high indigenous population of such gas atoms within the tube—both those which become positive ions and those more populous atoms that become electrically neutral but possibly chemically active atoms within the tube. Historically, this indigenous population of gas atoms resulted in the impact of many positive ions on the photocathode, resulting in a relatively short operating life for many early-generation $I^2T$'s.

As those ordinarily skilled in the pertinent arts will understand, later generation $I^2T$'s of the proximity focus type have partially solved this ion-impact problem by providing an ion barrier film on the inlet side of the MCP. This ion barrier film blocks the positive ions and prevents them from damaging the PC. However, the ion barrier film is itself the source of many disadvantages.

A recognized disadvantage of such an ion barrier film on an MCP is the resulting decrease in signal to noise ratio provided by the MCP between a PC of an $I^2T$ and the output screen electrode of the tube. That is, although the material of the ion barrier film acts as a secondary emitter of electrons for those electrons of sufficient energy, for lower energy photoelectrons this barrier also acts to preventing some of the electrons from reaching the microchannels of the MCP. Recalling that about 50% of the electron input face of a MCP is open area, and about the same percentage is defined by the solid portion or web of the microchannel plates, it is easily appreciated that about half of the photoelectrons impact on the web of the MCP.

These photoelectrons which impact the web of the plate bounce or rebound, or result in the production of secondary emission electrons, both conditions resulting in electrons closely adjacent to the face of the MCP with low energies. These low-energy electrons lack the energy to either penetrate the ion barrier film, or to cause this film to liberate secondary electrons. So these low energy electrons are absorbed by the ion barrier film. The result is that in some cases, as much as 50% of the electrons that would otherwise contribute to the formation of an image by the $I^2T$ arc blocked or absorbed by the ion barrier film and do not reach the microchannels to be amplified as described above. Thus, about the same percentage of the image information which theoretically could be provided by the tube is lost.

Another disadvantage of the ion barrier film is that it contributes to halo effect in the image provided by the conventional image intensifier tube. This halo effect may be visualized as photoelectrons incident on the web of the MCP, or on the ion barrier film itself, either themselves not penetrating this film to enter a microchannel and to be amplified, but bouncing off to again impact the film or the web at another location. At the other location, the process is repeated, with some of the electrons entering a microchannel, and some of the electrons again bouncing to yet a third location. This effect causes a halo or emission of light around locations of the image that do not correspond to a bright area of the scene being viewed. This halo effect reduces the quality of the image provided by an image intensifier tube, and reduces contrast values in this image. Importantly, for those photoelectrons below a certain energy value, the ion barrier film itself acts as a gain block with respect to the halo effect.

Another problem with image intensifier tubes using an ion barrier film is the voltage that must be provided (i.e., by the use of a higher applied voltage between the PC and the $I^2T$) to photoelectrons simply to compensate for the energy barrier represented by the film itself. Efficient penetration of the ion barrier film by photoelectrons requires about 600 to 1000 volts of applied potential.

Yet another source of image halo in conventional MCP's results from the excessive distance maintained between the PC and the front face of the MCP in these conventional $I^2T$'s. The conventional $I^2T$'s generally have a gap from PC to MCP no less than about 250$\mu$ meter (+ or − about 5$\mu$ meter). It is recognized that an important factor in the extent or degree of halo effect is the spacing between the PC and the MCP of an $I^2T$. However, conventional $I^2T$'s have not been able to provide a spacing as small at that achieved by the present invention.

Further, the conventional manufacturing processes for $I^2T$'s are inadequate to remove a sufficient quantity of the indigenous gas molecules from MCP's. Thus, the use of ion barrier films to protect the PC's of conventional Gen III image intensifier tubes has become industry-standard practice. Were it not for the presence of the ion barrier film on conventional MCP's, the Gen III type of PC's would be destroyed by positive ion bombardment in as little as two hours of operation. That is, the present Gen III $I^2T$'s would provide a service life of as little as two hours were they not provided with an ion barrier film on the MCP of these tubes. With the current ion barrier films, present Gen III $I^2T$'s provide a service life of about 2000 hours or more.

U.S. Pat. No. 3,720,535, issued Mar. 13, 1973; U.S. Pat. No. 3,742,224, issued Jun. 26, 1973; and U.S. Pat. No. 3,777,201, issued Dec. 4, 1973 provide examples of microchannel plates or image intensifier tubes having an ion barrier film on a microchannel plate. U.S. Pat. Nos. 5,015,909; and 5,108,961, issued May 14, 1991, and Apr. 28, 1992, and both assigned to Circon Corporation provide examples of glass compositions and methods which may be used in the fabrication of microchannel plates.

U.S. Pat. No. 4,978,885, issued Dec. 18, 1990 asserts to provide a process by which a sufficient amount of the indigenous gas molecules may be removed from a MCP that it may be operated without an ion barrier film. However, the process taught by the '885 patent is believed to have several disadvantages. First of all, the MCP's treated by this process are exposed to an applied voltage sufficient to cause regenerative ion feedback, and are at or above the threshold of ion runaway. Further, the MCP's during this process are asserted to be self-heating so that it is asserted that no supplemental heating of the MCP is necessary (i.e., no externally applied heat for bake out under vacuum is required).

This combination of circumstances taught by the '885 patent is believed to subject the MCP's to a risk of damage or destruction because of thermal runaway that may accompany the condition of ion runaway. Further, even when a MCP is reversed and treated by the process of the '885 patent with the direction of self-regenerating ion feedback taking place near each of the opposite ends of the microchannels, there possibly can remain a central area of the microchannels where self-regenerating ion and electron flux is not sufficient to degas the MCP.

SUMMARY OF THE INVENTION

In view of the deficiencies of the conventional related technology, it is desirable and is an object of this invention to provide an image intensifier tube which overcomes or reduces the severity of at least one deficiency of the conventional technology.

Thus, it is desirable and is an object for this invention to provide an improved $I^2T$ having a uniquely low level of indigenous gas atoms such that the tube will operate for a satisfactory interval while being continuously powered by a direct current (D.C.) power supply applying a conventional field level between the PC and MCP of the tube, level, and with no ion barrier film on the inlet face of the MCP.

Further, it is desirable and is an object for this invention to provide an improved NVD utlizing such an $I^2T$.

More particularly, the present invention relates to an improved $I^2T$ having an improved microchannel plate (MCP) with a low level of indigenous gas atoms.

It is well understood that some of the indigenous gas atoms present in a conventional $I^2T$ become positive ions during operation of an $I^2T$. Such positive ions move in a direction causing them to bombard a photocathode of the conventional $I^2T$, and thus to shorten the useful operating life of the conventional $I^2T$. Further, other and more populous indigenous gas atoms become neutral ions within the tube, some of which can chemically unite with the photocathode of the tube, and poison this photocathode so that its effectiveness to release photoelectrons in response to photons of light is decreased or destroyed.

In contrast, the present $I^2T$ has such a low indigenous population of gas atoms that the resulting low level of ion bombardment of the PC allows an acceptably long operating life for the $I^2T$, even when the tube is operated without an ion barrier film on the MCP.

The present $I^2T$ also has an extraordinarily low level of image halo.

Accordingly, it is a specific object for this invention to provide a night vision device having an image intensifier tube with a microchannel plate not having an ion barrier film on its inlet face (and therefore, having microchannels which are open to receive photoelectrons directly from a photocathode of the tube) and with a novel and inventively low level of indigenous gas molecules within the tube so that a PC of the tube provides a satisfactory life span while the tube is being operated by a continuous DC power supply applying a conventional level of electric field between the PC and MCP of the image tube.

To this end, the present invention according to one aspect provides a night vision device comprising: an objective lens receiving light from a scene being viewed and directing this light to an image intensifier tube, the image intensifier tube providing a visible image of the scene being viewed, and an eyepiece lens providing this visible image to a user of the night vision device; the image intensifier tube having a chambered evacuated housing, and including in the chamber of this housing a photocathode receiving photons from the scene and releasing photoelectrons in a pattern replicating the scene, a microchannel plate having microchannels opening in the direction of the photocathode to receive the photoelectrons and responsively providing a shower of secondary emission electrons in a pattern replicating the scene, and a screen receiving the shower of secondary emission electrons and producing a visible image replicating the scene, the chamber of the housing having a level of indigenous gas molecules which become positive ions during operation of the tube which is sufficiently low that the image intensifier tube operates for at least as much as about 400 or 500 hours or more, while being operated with continuous DC power.

It also would be an advantage and is an object for this invention to provide an $I^2T$ with a closer spacing between the PC and the MCP of the tube than has been achieved by conventional $I^2T$'s.

Further, it is an object for this invention to provide an $I^2T$ which provides an image with substantially reduced or eliminated image halo.

Advantages which derive from this invention include the provision of an image intensifier tube with a microchannel plate which does not have an ion barrier film, and yet which operates for a satisfactory interval (i.e., provides a satisfactory service life) while being powered by an essentially a DC power supply applying an essentially conventional level of electric field between the PC and MCP of the image tube.

The Applicant has discovered that, in contrast to the conventional technology, and by use of the present invention, the spacing between the PC and the MCP in an $I^2T$ may be reduced to a distance in the range from about 50% of the conventional value to a distance which is substantially an order of magnitude less than the conventional spacing. That is, the PC to MCP spacing may be reduced substantially to about $50\mu$ meter or less). Most preferably, the gap from PC to MCP may be reduced to as little as about $15\mu$ meter. The image halo effect of the improved $I^2T$ is correspondingly reduced.

Further, the $I^2T$ according to the present invention may operate on lower applied voltages between the PC and MCP, so that the applied electric field between the PC and MCP is maintained at about the same level as that employed in conventional $I^2T$'s.

Further, the Applicant has determined that much of the positive ion population within conventional image intensifier tubes originates with gas molecules adsorbed onto surfaces of the MCP itself (i.e., gas molecules which are indigenous to the MCP). The typical MCP is itself a relatively small structure essentially a glass plate about 25 mm in diameter by about one mm or less in thickness with electrodes on its opposite faces. However, when it is realized that the MCP may have as many as 11 million, or more microchannels, it may be appreciated that the total surface area of all the exterior and interior surfaces of the MCP (that is, including the interior surface area of all of these microchannels) can be quite large. Thus, a MCP can harbor a considerable quantity of indigenous (or adsorbed) gas.

Conventional manufacturing processes for making $I^2T$'s include a bake and scrub process during which the MCP is exposed to elevated temperatures and/or an electron beam scrubbing of the MCP, while it is subjected to a differential voltage across the MCP, all in order to remove as much as possible of the indigenous gas molecules. The conventional MCP is subjected as well to an exhaust process during which the image intensifier tube (and MCP)) are exposed to deep vacuum and elevated temperatures. This exhaust process is part of the vacuum furnace brazing operation for the body of the $I^2T$.

In contrast to the conventional image intensifier tube, a tube embodying the present invention is subjected to a much more vigorous electron beam scrub. This e-beam scrub is so vigorous in fact that conventional MCP's would be destroyed by it. An effect of this exceedingly and unconventionally vigorous e-beam scrub is that the MCP is so clean (i.e., free of indigenous gas atoms) that the $I^2T$ may operate for a satisfactory service life even though the tube includes no ion barrier film on the MCP.

Accordingly, an advantage results from the reduced electron energy necessary to introduce electrons into the microchannels of the MCP in comparison to conventional image intensifier tubes. Because the microchannels of an image intensifier tube embodying the present invention are open in the direction facing the photocathode (no ion barrier film is present to restrict electron entry) and the photoelectrons have essentially no barrier to overcome. This is in contrast to conventional proximity focused image intensifier tubes, which have an ion barrier on the input side of the MCP. As explained above, in conventional $I^2T$'s electrons must effectively penetrate the ion barrier to get into the microchannels of the conventional image intensifier tube. Thus, the voltage applied to the photocathode of an image tube operated according to the invention can be lowered in proportion to a reduction of the PC-to-MCP spacing as may be desired to reduce halo, while still providing an adequate level of applied electric field, and also still providing an adequate flow of photoelectrons to the microchannel plate. This advantage allows use of a smaller lower-voltage power supply.

Further, without an ion barrier film, the production of electrons which contribute to the image halo effect in an $I^2T$ embodying the present invention is further reduced.

Manufacturing of an $I^2T$ embodying the invention can be less expensive that conventional tubes because a manufacturing operation to add the film to the MCP is not required. Further, a high voltage power supply to operate the inventive tube may be less expensive because it does not need to provide as high a voltage differential between the PC and the front face of the MCP.

Other objects, features, and advantages of the present invention will be apparent to those skilled in the art from a consideration of the following detailed description of a preferred exemplary embodiment thereof taken in conjunction with the associated figures which will first be described briefly.

BRIEF DESCRIPTION OF THE DRAWING FIGURES

Figure 2:
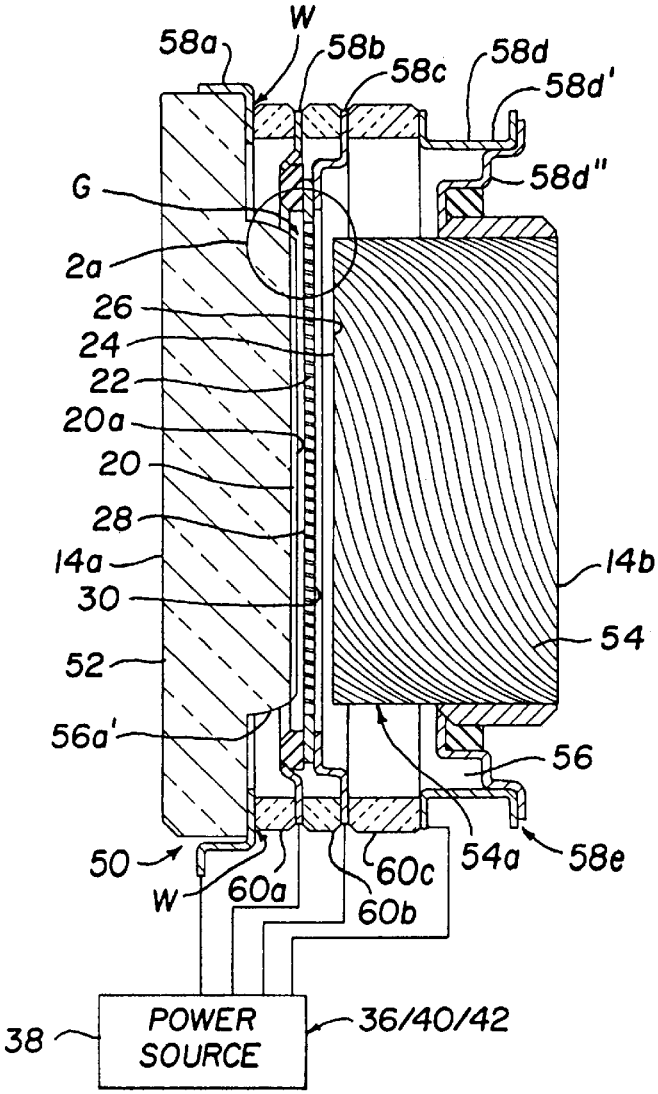
FIG. 2 shows an $I^2T$ in longitudinal cross section, with an associated power supply.
Figure 2A:
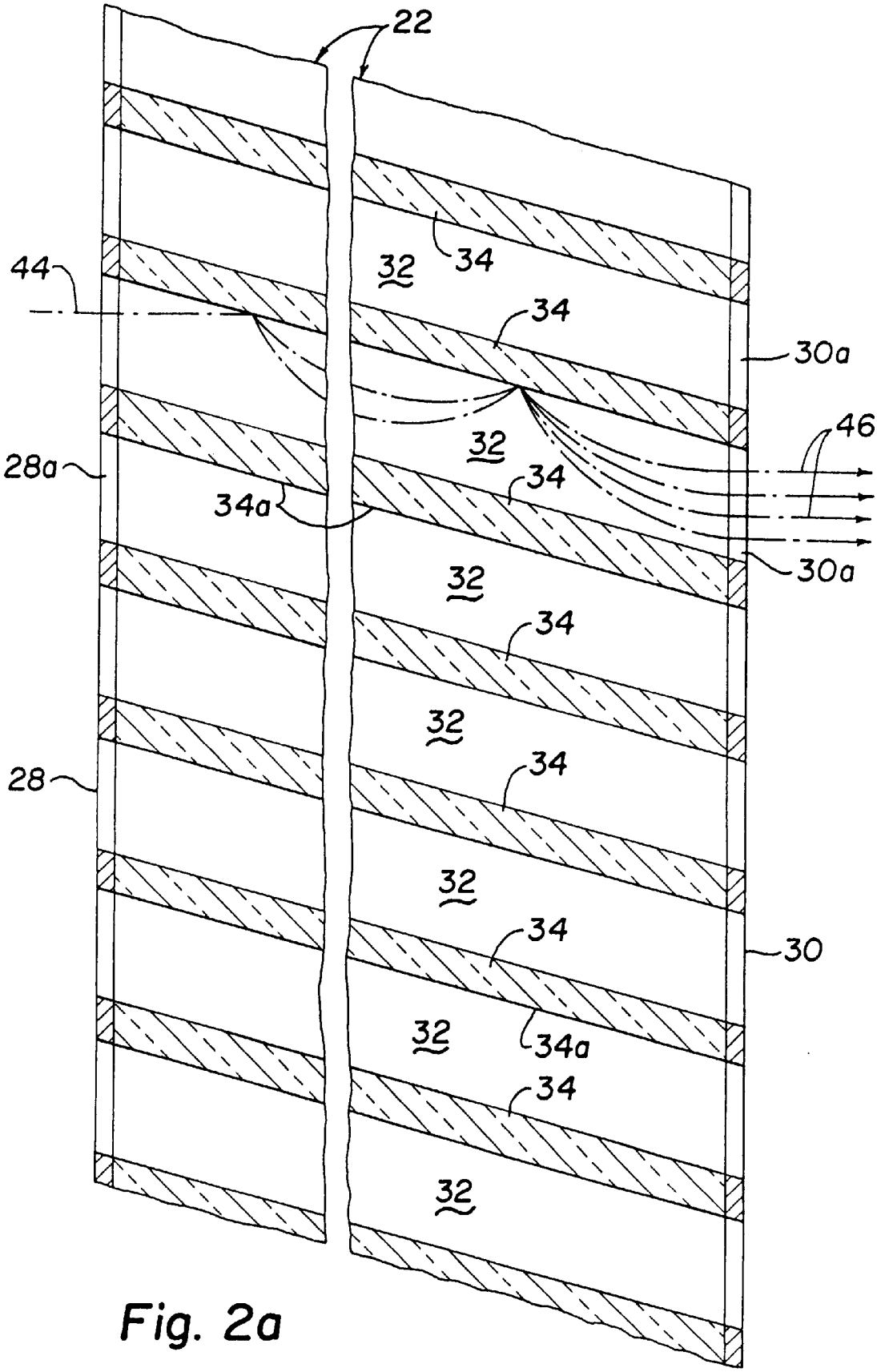
Figure 3:
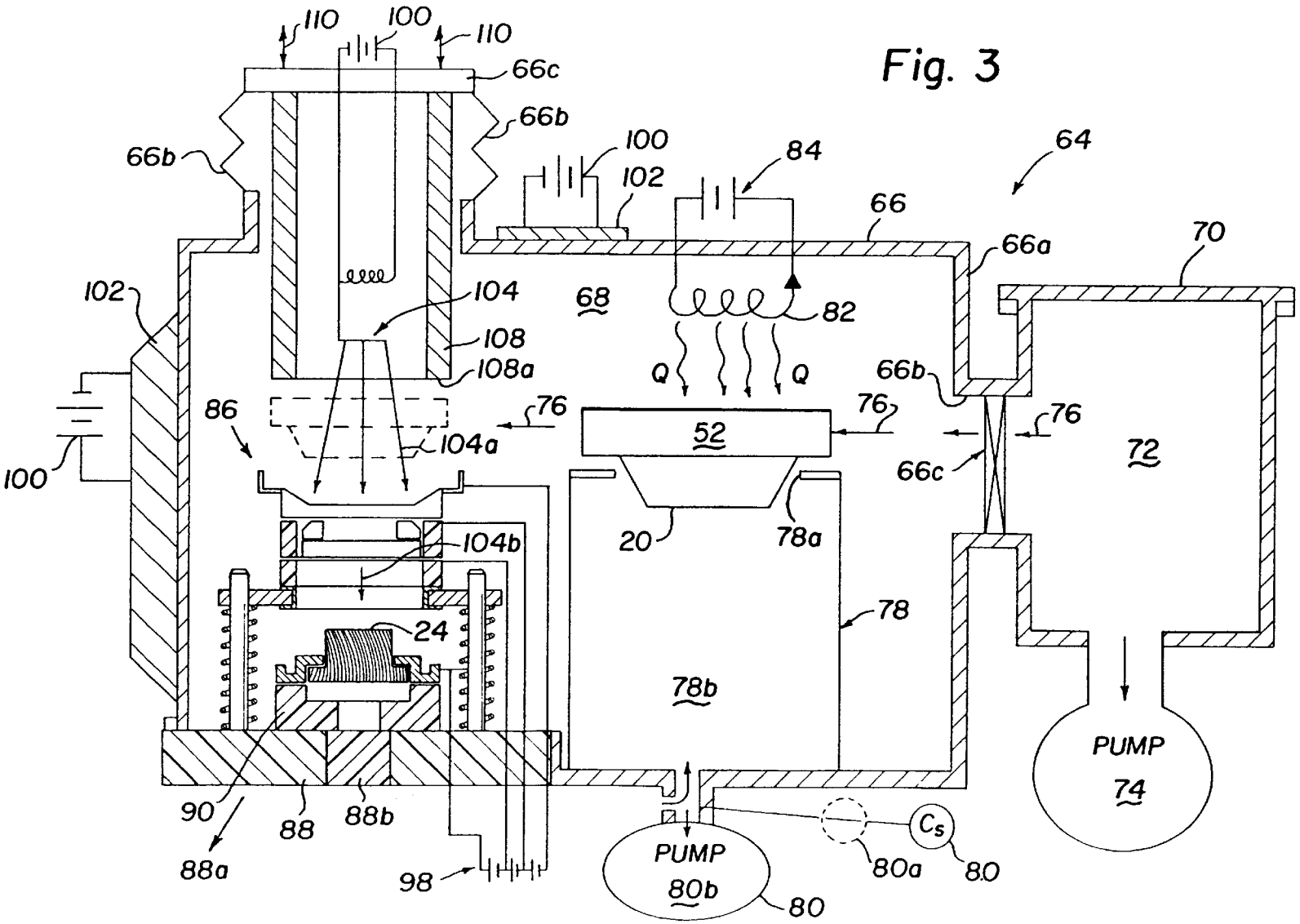
Figure 3A:
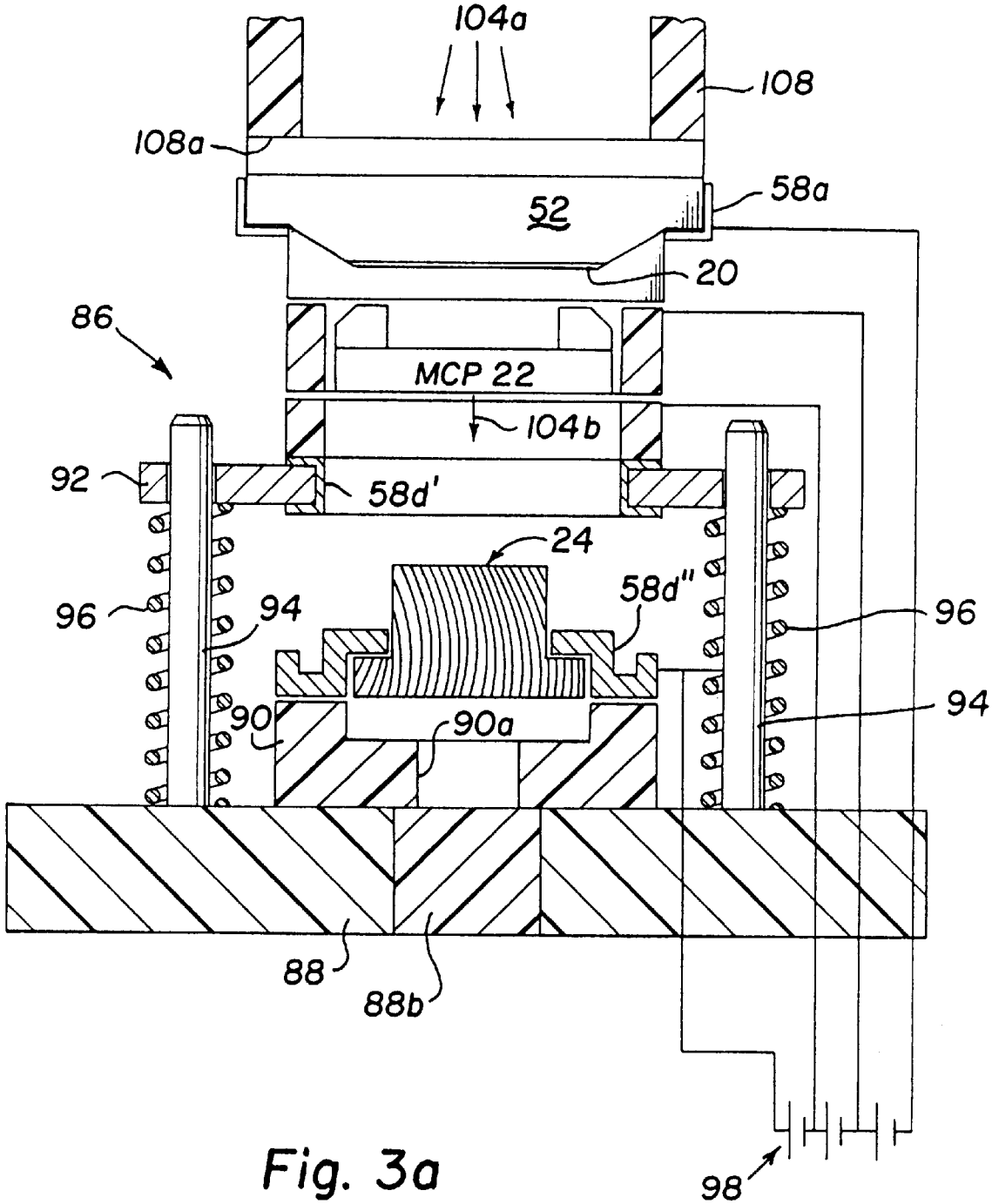

FIG. 2*a* is a greatly enlarged fragmentary cross sectional view of a portion of the microchannel plate of the $I^2T$ seen in FIG. 2;

FIG. 3 is a schematic representation of a step in the manufacturing process of making an improved MCP for an $I^2T$ embodying the present invention, and of a device used in carrying out this step; and FIG. 3*a* is an enlarged fragmentary view of a portion of the device seen in FIG. 3.

DETAILED DESCRIPTION OF AN EXEMPLARY PREFERRED EMBODIMENT OF THE INVENTION

While the present invention may be embodied in many different forms, disclosed herein is a specific exemplary embodiment that illustrates and explains the principles of the invention. It should be emphasized that the present invention is not limited to the specific embodiment illustrated and described.

Figure 1:
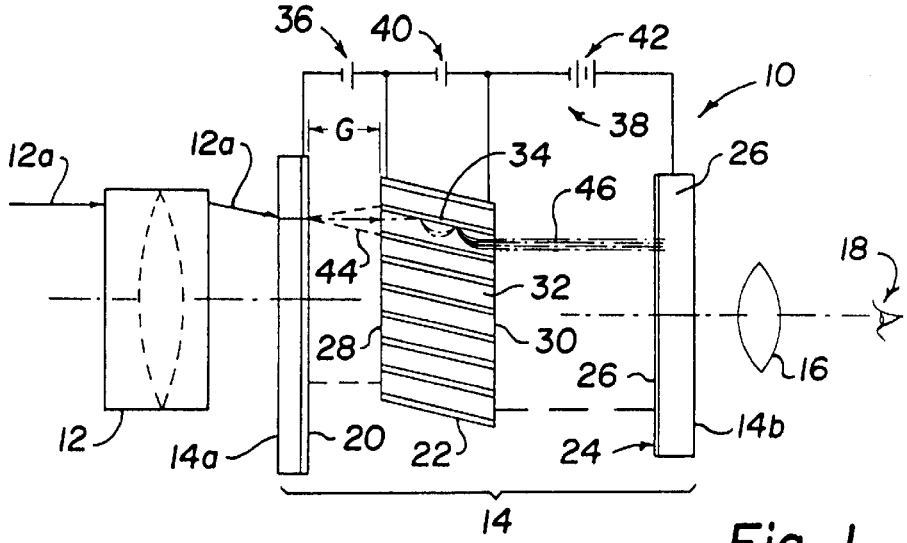
FIG. 1 is a schematic representation of a night vision device embodying the present invention.

Referring first to FIG. 1, there is shown schematically the basic elements of one version of a night vision device 10 of the light amplification type. Night vision device 10 generally comprises a forward objective optical lens assembly 12 (illustrated schematically as a functional block element having a lens depicted in dashed lines—and which may include one or more lens elements). This objective lens 12 focuses incoming light 12*a* from a distant scene (which may be a day-time scene illuminated with full day light, as will be explained, or may be a night-time scene illuminated with only star light or with infrared light from another source) through the front light-receiving end surface 14*a* of an image intensifier tube ($I^2T$) 14. As will be seen, this surface 14*a* is defined by a transparent window portion of the tube—to be further described below. As was generally explained above, the $I^2T$ provides an image at light output end 14*b* in phosphorescent yellow-green visible light, which image replicates the viewed or night-time scene.

Hereinafter, no distinction is maintained between the cases in which the scene is visible with natural vision to the user of the device, and the cases in which the scene is totally invisible to natural vision because it is illuminated only with star light or other infrared light. The device 10 can provide a visible image replicating the scene for the user under both of these extreme conditions, and at all illumination levels between these extremes. Again, a night time scene would generally be not visible (or would be only poorly visible) to a human's natural vision. The visible image from the $I^2T$ is presented by the device 10 to a user via an eye piece lens illustrated schematically as a single lens 16 producing a virtual image of the rear light-output end of the tube 14 at the user's eye 18.

More particularly now viewing FIG. 2, it is seen that $I^2T$ 14 includes a photocathode (PC) 20 which is responsive to photons of infrared light to liberate photoelectrons, a microchannel plate (MCP) 22 which receives the photoelectrons in a pattern replicating the night-time scene, and which provides an amplified pattern of electrons also replicating this scene, and a display electrode assembly 24. In the present embodiment the display electrode assembly 24 may be considered as having an aluminized phosphor coating or phosphor screen 26. When this phosphor coating is impacted by the electron shower from microchannel plate 22, it produces a visible image replicating the pattern of the electron shower. Because the electron shower in pattern intensity still replicates the scene viewed via lens 12, a user of the device can effectively see in the dark, viewing a scene illuminated by only star light or other low-level or invisible infrared light. A transparent window portion 24*a* of the assembly 24 (to be further described below) conveys the image from screen 26 outwardly of the tube 14 so that it can be presented to the user 18. The window portion 24*a* may be plain glass, or may be fiber optic, as depicted in FIG. 2. Those ordinarily skilled will understand that a fiber optic output window 24*a* may invert the image provided by the screen 26.

Still more particularly considering FIGS. 2 and 2*a*, the MCP 22 is located just behind PC 20, with the MCP 22 having an electron-receiving face 28 and an opposite electron-discharge face 30. According to the present invention, the electron-receiving face 28 of the MCP 22 is preferably located as close as 15$\mu$ meter or closer behind the PC 20. More preferably, the the tube 14. A gated power supply will likely extend the operating life of the tube 14 even further.

Most preferably, the walls of 34 of microchannel plate 22 are fabricated of a cladding glass according to the teachings of the Circon Corporation patents referenced above. However, heretofore, microchannel plates for Gen III $I^2T$'s (even if made from this same Circon Corporation glass) have generally required the use of an ion barrier film on the electron input face 28 of the MCP. Further, those MCP's taught by the '885 patent referenced above are believed to not be made of this same glass, and to additionally subject the MCP to a risk of thermal runaway and damage or destruction because of the process used to de-gas these conventional MCP's, as explained above. Consequently, a reliable manufacturing method for such a MCP, and an image intensifier tube using such an MCP, has not been known prior to this invention, it is believed.

Still viewing FIGS. 2 and 2*a*, it is seen that each face 28 and 30 of the MCP 22 carries a conductive electrode layer 28*a* and 30*a*, respectively. These conductive electrode layers may be metallic, or may be formed of other conductive material so as to distribute an electrostatic charge over the respective faces of the microchannel plate 22. These electrode coatings do not span across the openings of the microchannels 32, and do not close the openings of these microchannels. Also, there is no ion barrier film or coating on either face 28 or face 30, so that the microchannels 32 are open in a direction disposed toward the photocathode (again, leftwardly, viewing FIGS. 2 and 2*a*). A power supply section 40 of circuit 38 provides a differential voltage across the faces 28 and 30 (i.e., by application to the electrode layers 28*a* and 30*a*). Consequently, the MCP 22 has both an improved signal-to-noise ratio (because no electron absorption is experienced at an ion barrier film), and has no contribution to a halo effect—which halo effect is conventionally contributed to by such an ion barrier film on the electron input side of conventional MCP's. Further, the manufacturing of the MCP 22 may be less expensive because of the elimination of the step of applying such an ion barrier film.

The display electrode assembly 24, generally has a conductive coated phosphor screen 26, is located behind microchannel plate 22 with phosphor screen 26 in electron line-of-sight communication with the electron-discharge face 30 of the MCP 22. The display electrode assembly 24 is typically formed of an aluminized phosphor screen 26 deposited on the spacing from the PC 20 to the face 28 is less than 125$\mu$ meter, and may be as little as 15$\mu$ meter or less.

The microchannel plate 22 further contains a plurality of angulated microchannels 32 which open on the electron-receiving face 28 and on the opposite electron-discharge face 30. Microchannels 32 are separated by passage walls 34. At least a portion of the surface of the passage walls 34 bounding the channels 32 is defined by a material 34*a*, which is an emitter of secondary electrons. In this case, and in contrast to conventional image intensifier tubes of the illustrated proximity focused type, the microchannel plate does not carry an ion barrier film or coating on input face 28. Accordingly, the microchannels 32 open on both faces of the plate 22 (i.e., on face 28 and on face 30), and are not obstructed at their inlet ends by an ion barrier film (i.e., at the left end of the microchannels viewing FIGS. 2 and 2*a*, which is on face 28 and is disposed toward PC 20).

As is seen in FIGS. 1 and 2, the MCP 22 is spaced behind the PC 20 by a gap indicated with the character "G". In the present $I^2T$, the gap "G" is preferably in the range from about 125$\mu$ meter to as little as about 15$\mu$ meter, or less. Most preferably according to the present invention, the gap "G" is about 15$\mu$ meter or less.

A power supply section 36 of a power supply circuit, generally indicated with the numeral 38, provides a differential voltage between the PC 20 and face 28 of the MCP 22. In order to maintain about the same conventional level of electric field between the PC and the face 28 of MCP 22 despite the considerably lower than conventional spacing between these components (i.e., the spacing gap, "G"), a considerably lower than conventional voltage is required of power supply section 36. That is, the power supply section 36 is required to provide less voltage than is required of the power supplies which are used to operate conventional $I^2T$'s. Further, the power supply section 36 may provide a direct current voltage supply to the PC 20, or it may provide a voltage that is gated on and off in a duty cycle. While the $I^2T$ 14 according to the present invention will have a sufficiently low level of indigenous gas molecules that its operating life is satisfactory even when operated with direct current voltages (and despite not having an ion barrier film on the MCP input face 28), there may be some applications in which operating advantages of using gated power mitigate in favor of using such a power supply with vacuum-exposed surface of the optically transparent material of window portion 24*a*. A voltage supply section 42 of circuit 38 provides a differential voltage between the electrode 30*a* and the display electrode assembly 24.

The focusing eye piece lens 16 is located behind the display electrode assembly 24 and allows an observer 18 to view a correctly oriented image corresponding to the initially received low-level image.

As will be appreciated by those skilled in the art (also viewing now particularly FIG. 2), the individual components of $I^2T$ 14 are all mounted and supported in the body of a tube or chamber (to be further explained below) having forward and rear transparent plates cooperating to define a chamber which has been evacuated to a low pressure. This evacuation allows electrons liberated into the vacuum free-space within the tube to be transferred between the various components by prevailing electrostatic fields without atmospheric interference. Because of the close proximity of the components of this type of image intensifier tube, it is referred to as a "proximity focused" type of tube.

As indicated above, photocathode 20 is mounted immediately behind objective lens 12 on the inner vacuum-exposed surface of the window portion of the tube and before microchannel plate 22. Typically, this photocathode 20 is a circular disk-like structure having a predetermined construction of semiconductor materials, and is mounted on a substrate in a well known manner. Suitable Gen III photocathode materials are generally semi-conductors such as gallium arsenide (GaAs), carried on a readily available transparent substrate. A variety of glass and fiber optic substrate materials are commercially available.

Considering in somewhat greater detail the operation of the $I^2T$ 14, it will be understood that light 12*a* includes photons which enter the forward end of night vision device 10 and pass through objective lens 12. These photons 12*a* are focused on the photocathode 20, which has an active surface 20*a* from which are emitted photoelectrons 44 in numbers proportionate to and at locations replicative of the received optical energy of the night-time scene being viewed (i.e., proportionate to photon flux). Again, and in general, the image received will be too dim to be viewed with human natural vision, and may be entirely or partially of infrared radiation which is invisible to the human eye. It is thus understood that the photoelectrons emitted from the photocathode 20 are in a pattern representative of the image entering the forward end of $I^2T$ 14.

The path of a typical photoelectron emitted from the photon input point on the photocathode 20 is represented in FIG. 1 by arrowed line 44. Photoelectrons 44 emitted from photocathode 20 gain energy through an electric field of predetermined intensity gradient established between photocathode 20 and the electrode 28*a* on electron-receiving face 28 of MCP 22, which field gradient is provided by power supply section 36. Because the photoelectrons are not required to overcome penetration energy requirement presented by an ion barrier film, but instead may enter directly into the open microchannels of the MCP 22, the voltage applied by the power supply section 36 can be much lower than that required of a power supplies operating a MCP of a conventional $I^2T$. However, and preferably, in the $I^2T$ 14 substantially the same level of electric field is maintained in gap "G" as that existing between the PC and MCP of conventional Gen III $I^2T$'s. Typically, power source section 36 will apply an electrostatic field voltage on the order of 40 to 100 volts/mil in order to create a field of the desired intensity.

After accelerating over a distance (i.e., across gap "G") between the photocathode 20 and the input surface 28 of the microchannel plate 22, these photoelectrons 44 enter microchannels 32 of microchannel plate 22. As explained above, the power supply section 40 provides a differential voltage across the electrodes 28*a* and 30*a* of the MCP 22. As will be discussed in greater detail below, the photoelectrons 44 are amplified by emission of secondary electrons to produce a proportionately larger number of electrons upon passage through the microchannels 32 of microchannel plate 22. This amplified shower of secondary-emission electrons (indicated with arrowed reference numeral 46), which is also accelerated within the microchannels 32 by the respective electrostatic field supplied by power supply section 40, then exits the microchannels 32 of microchannel plate 22 at electron-discharge face 30.

Once in free space again, the amplified shower of secondary-emission electrons is again accelerated in an established electrostatic field provided by power supply section 42. This field is established between the electron-discharge face 30 and display electrode assembly 24. Typically, the power supply section 42 produces a potential on the order of 3,000 to 7,000 volts, and more preferably on the order of 6,000 volts in order to impart the desired energy to the multiplied electrons 46.

The shower of photoelectrons and secondary-emission electrons 46 (those ordinarily skilled in the art will know that considered statistically, the shower 46 is almost or entirely devoid of photoelectrons and is made up entirely or almost entirely of secondary-emission electrons (i.e., because statistically, the probability of a photoelectron avoiding absorption in the microchannels 32 is low). However, the shower 46 may be several orders of magnitude more intense than the initial shower of photoelectrons 44, but is still in a pattern replicating the image focused on photocathode 20. This amplified shower of electrons falls on the phosphor screen 26 of display electrode assembly 24 to produce an image in visible light.

Viewing FIG. 2 in greater detail, the $I^2T$ 14 is seen to include a tubular body 50, which is closed at one of its two opposite ends by a front light-receiving window 52, and at the opposite end by a rear fiber-optic image output window 54. The window 54 defines the light output surface 14*b* for the tube 14, and carries the display electrode assembly including phosphor coating 26, as will be further described. As is illustrated in FIG. 2, the rear window 54 may be an image-inverting type (i.e., of fiber optic type, with optical fibers bonded together and twisted as a group through 180° between the opposite faces of this window 54) in order to provide an erect image to the user 18. The window member 54 is not necessarily of such inverting type.

Both of the windows 52 and 54 are sealingly engaged with the body 50, so that an interior chamber 56 of the body 50 can be maintained at a vacuum relative to ambient. The tubular body 50 is made up of plural metal rings, each indicated with the general numeral 58 with an alphabetical suffix added thereto (i.e., 58*a*, 58*b*, 58*c*, and 58*d* successively from front to rear of the tube body 50) as is necessary to distinguish the individual rings from one another. It will be noted in FIG. 2 that the ring 58*d* is composed of two ring parts, indicated respectively with numerals 58*d*' and 58*d*", which are united sealingly with one another at a weld 58*e*. The significance of this construction feature will be further explained below.

The tubular body sections 58 are spaced apart and are electrically insulated from one another by interposed insulator rings, each of which is indicated with the general numeral 60, again with an alphabetical suffix added thereto (i.e., 60*a*, 60*b*, and 60*c* successively from front to rear of body 50). The sections 58 and insulators 60 are sealingly attached to one another. End sections 58*a* and 58*d* (i.e., ring part 58*d*") are likewise sealingly attached to the respective windows 52 and 54. Those ordinarily skilled in the pertinent arts will know that the body sections 58 are individually connected electrically to power supply circuit 38 (which provides sections 36, 40, and 42, as described above). This power supply circuit is effective during operation of the $I^2T$ 14 to maintain an electrostatic field most negative at the section 58*a* and most positive at the section 58*d*.

Further viewing FIG. 2, it is seen that the front window 52 carries on its rear surface within the chamber 56 the photocathode 20. The body section 58*a* is electrically continuous with the photocathode by use of a thin metallization (indicated on FIG. 2 with reference numeral 58*a*') extending between the section 58*a* and the photocathode 20. Thus, the photocathode 20 by reason of this electrical connection and because of its semi-conductive nature, has an electrostatic charge distributed across the areas of this disk-like photocathode structure.

Also as was mentioned above, a conductive coating or layer 28*a*, 30*a* is provided at each of the opposite faces 28 and 30 of the microchannel plate 22 (as is indicated by arrowed numerals 28*a* and 30*a* on FIG. 2*a*). Power supply section 40 is electrically connected with these coatings by connection to housing sections 58*b* and 58*c*. Finally, the power supply section 42 is conductive with a conductive layer or coating 54*a* (possibly an aluminum metallization similar to coating 58*a*') at the display electrode assembly 24 and extending across the vacuum-exposed surfaces of the window member 54.

Having considered the structure of the NVD 10 and its $I^2T$ 14, attention may now be given to the manufacturing of this $I^2T$. Those ordinarily skilled in the pertinent arts will understand that the MCP 22 is made by drawing fine-dimension fibers of glass which include a core (i.e., of core glass composition) and a cladding (i.e., of cladding glass composition) which cladding glass can be made electrically active as a secondary emitter of electrons. Again, reference may be had to the teachings of the patents of Circon Corporation, referenced above, for possible formulations for the glasses from which the MCP 22 may be made. One of these cladding glasses is known as NV-30P. This cladding glass may be used to practice the present invention. The fibers of the selected glasses are formed into a plate that (after removal of the core glass) is partially perforate (i.e., perforated by the microchannels 32), and is subsequently processed to add electrodes 28*a* and 30*a*. After this MCP is fabricated, it is sealed into the body 50 of tube 14. During the manufacturing operation leading up to the sealing of tube body 50 to capture a deep vacuum within the chamber 56, the MCP 22 is processed substantially according to the following example, which has the effect of substantially degassing the MCP 22.

Viewing now FIGS. 3 and 3*a*, a schematic depiction is presented of a vacuum bake and electron beam scrubbing device 64 having a housing 66 with walls 66a defining a chamber 68. The chamber 68 has selective communication (as will be explained) with ambient, and includes therein devices and apparatus (described more fully below) for assembling the image intensifier tube 14 under high vacuum conditions. In other words, the components of the image intensifier tube 14 are prepared in the chamber 68 for operation together, and the parts of the tube body 50 are then sealingly united to capture a deep vacuum in the chamber 56. The housing 66 includes a wall portion 66*a* (as mentioned above) which defines the chamber 68 and an opening or portal at 66*b*. This opening 66*b* is selectively and sealingly closed by a door 66*c* (indicated on FIG. 3 in a closed position and illustrated merely with an "X" symbol). That is, this door 66*c* may be selectively opened and closed from outside of the device 64. The opening 66*b* leads to a load-lock device 70, which is a form of air lock allowing items to be passed therethrough into or out of the chamber 68. The load-lock device 70 defines an ante-chamber 72, and a vacuum pump 74 communicates with this ante-chamber to allow this chamber to be selectively evacuated to a deep vacuum.

Operating inside of the chamber 68 is a conveyor device, schematically indicated with the arrows 76, which allows a photocathode assembly including front window 52 and PC 20 carried thereon to be moved sequentially from the anti-chamber 72 through the opening 66*b* and into the chamber 68. In the chamber 68, the assembly of window 52 and PC 20 initially rest in alignment with and in sealed relationship with an activation dome 78. The conveyor device 76 also allows the assembly of window 52 and PC 20 to also be subsequently moved from the activation dome 78 to another location within chamber 68 for subsequent processing, as will be explained. As first associated with the activation dome 78, the photocathode assembly of window 52 and PC 20 is rested upon and sealingly nested with the activation dome 78 at an opening 78*a* that the PC 20 is disposed inwardly of this dome. Thus, the PC 20 is exposed to a chamber 78*b* defined within the dome 78.

This activation dome is selectively communicated to a source 80 of activating gas or gasses, one of which may be cesium gas, so that the PC 20 can be activated by exposure to these gasses. Flow of the activating gasses from the source 80 into chamber 78*b* may be controlled by a valve 80*a* (represented with dashed lines in FIG. 3), or may be effected, for example, by use of a controlled chemical reaction which releases at lease one of the desired activation gasses. The chamber 78*a* is also communicated to a vacuum pump 80*b* so that the gasses from source 80 can be withdrawn from the chamber 78*b*.

Additionally, a heater 82 is juxtaposed to the photocathode assembly 52 when it is disposed on the activation dome 78. This heater is selectively supplied with electric power by a power supply 84, so that the PC 20 may be prepared for activation at activation dome 78 to its condition of being sensitive to photons of light to release photoelectrons, as was explained above in connection with operation of the $I^2T$ 14.

Also located in chamber 68 is a fixture generally indicated with the numeral 86 (best seen in FIG. 3*a*). This fixture 86 is carried on a removable vacuum-sealing flange 88 which sealing attaches to the housing 66, but which is also removable (as is indicated by arrow 88*a*) both to allow a subassembly for $I^2T$ 14 to be placed into the chamber 68 and to allow a finished $I^2T$ 14 to be removed from the device 64.

FIG. 3*a* shows the fixture 68 in greater detail, and shows that this fixture includes a reaction plate 90 carried on the flange 88. This reaction plate 90 carries the body ring part 58*d*", along with window 54 and display electrode 24. The reaction plate 90 may have an aperture 90*a*aligned with a sight glass 88*b* set into flange 88 so that illumination of the display electrode 24 is visible from outside of the device 68 by peering into and through this sight glass 88*b*.

Disposed above the reaction plate 90 and the ring 58*d*" carried thereon is the partially assembled body of $I^2T$ 14. That is, the body ring 58*d*' is confronting and spaced from ring 58*d*", and the remainder of the rings 58*b–c* and 60*a–d* are assembled to one another. The ring 58*d*' is supported in a clamp plate 92 slidably carried on a plurality of guide posts 94 carried by the flange 88. Interposed about the posts 94 between the flange 88 and the clamp plate 92 are respective springs 96 which bias the clamp plate 92, and the partially assembled body 50 of $I^2T$ 14 yieldably upward to the position seen in FIG. 3*a*.

The fixture 86 provides for support of this partially complete $I^2T$ assembly 14*a*, as well as providing for electrical connections to the various sections of this assembly, as will be seen. At the stage of manufacture illustrated in FIG. 3, the assembly 14*a* is missing the front window 52 as described above, and also is separated from its rear window 54. Accordingly, the MCP 22 of this assembly 14*a* is exposed outwardly to the chamber 68, as is seen in FIG. 3*a*. The screen electrode 24 is aligned with the MCP 22, however, as is also seen in FIG. 3*a*.

Further, an operating voltage may be applied across the faces 28*a* and 30*a* of the MCP 22, as well as to the front body ring 58*a*, and ring part 58*d*" by a power supply circuit associated with the device 64, as is generally indicated by the numeral 98 (best seen in FIG. 3*a*). Another power supply 100 selectively provides power to a heater 102 which disposed about the housing 66, so that the device 64 and its contents can be heated to a temperature above ambient. As is seen in FIG. 3, the power supply 100 may provide power to plural heaters 102 located at various places on the wall 66*a* of the housing 66. Disposed in the chamber 68 above the MCP 22 is an electron source 104. Electrons, indicated by arrows 104*a*, may be selectively driven off of source 104 and toward the exposed MCP 22 by a differential voltage applied by a power supply 106. The power supply 106 also provides power to a heater 106*a* to assist in driving off electrons from source 104.

Consequently, a selectively controlled electron flux, indicated by arrows the 104*a*, can be directed from the source 104 at MCP 22 while it is held in fixture 86 within the chamber 68. The power supply 98 may be employed to simultaneously apply a differential voltage across the MCP 22 and to consequently deliver an amplified electron flux 104*b* to the screen electrode 24. Thus, the MCP 22 may be scrubbed by electron fluxes 104*a* and 104*b*, and can be baked under deep vacuum in chamber 68 by controlled heating with heaters 102.

Disposed about the electron source 104 and in alignment with the fixture 86 is a pressing sleeve 108 having an end edge surface 108*a* configured to forcefully engage the window 52 near its outer periphery in alignment with body ring 58*a*. The housing 66*a* includes a bellows section 66*b* extending between the wall 66*a* and a pressing plate portion 66*c* of the housing 66 so that the pressing plate portion 66*c* can be forcefully and controllably moved downwardly from the position seen in FIG. 3 toward the fixture 86. In order to effect this forceful and controlled movement of the presser plate part 66*c* of the housing 66, a jacking device 110 (indicated schematically by the arrows in FIG. 3) is disposed outside of the housing 66, and controllably applies either an inward or an outward force to the plate 66*c*, as is indicated by the arrows on FIG. 3. Thus, the jacking device 110 controls the position of presser plate 66*c*, and of pressing sleeve 110 relative to the fixture 86 and the partially assembled body for $I^2T$ 14.

In the use of the device 66, after the MCP 22 has been vacuum baked and electron scrubbed in the fixture 86, and the photocathode 20 has been activated by exposure to activating gas from the source 80, the conveyor 76 is employed to bring the window 52 and PC 20 from the activation dome 78 into alignment with the fixture 86 and under the pressing sleeve 108. Most preferably, during this electron scrubbing of the MCP, as the assembly 14*a* is exposed to deep vacuum and heat in the chamber 68, the electron source 104 is employed to effect an electron beam (i.e., e-beam) scrubbing of the MCP 22 to assist in driving off gas atoms from this MCP. According to the process of the present invention, the e-beam scrub 104*a* has a current density of at least $25\mu$ A/cm$^2$. More preferably, the electron beam density is $75\mu$ A/cm$^2$, and may be as much as $300\mu$ A/cm$^2$, or possibly more.

Again, once this process of heat, deep vacuum, and e-beam scrubbing is completed to clean the MCP 22 of assembly 14*a*, the conveyor 76 is then employed to move the window member 52 into alignment with the fixture 86. Thus, the components of the $I^2T$ 14 are prepared for final assembly to make a completed image intensifier tube 14. The jacking device 110 is then used to controllably force the sleeve 108 inwardly of chamber 68 (downwardly viewing FIGS. 3 and 3*a*) and into engagement with the window 52 which is in alignment with the ring 58*a*. The window 52 and ring 58*a* have an indium coating at their aligned surfaces (indicated in FIG. 2 by the arrowed character "W"), which is used to effect a cold-weld seal between these parts under pressure applied by sleeve 108.

At this time, the sleeve 108 will first force the clamp plate 92 downwardly against the bias of springs 96 so that the body ring 58*d*' contacts the body ring 58*d*". These two body rings similarly have indium coatings on their aligning surfaces so that they likewise form an indium cold-weld under pressure applied by sleeve 108 and jack 110. The reaction plate 90 accepts this force from the jack device 110 in order to allow enough pressure to be applied to sealingly unite the portions of body 50.

Again considering the degassing operation for the MCP 22 (i.e., under the effect of electron fluxes 104*a* and resulting amplified flux 104*b*), which is conducted in chamber 68 before the components of the tube 14 are assembled, it will be understood that preferably the electron flux 104*a* is in the range of from $25\mu$ amp/cm$^2$ to as much as $300\mu$ amp/cm$^2$, or possibly more. Similarly, the applied voltage across the MCP 22 is generally preferred to be slightly higher than the applied voltage at which the MCP 22 will operate when it is installed in the $I^2T$ 14. The electron flux 104*a* is applied in the same direction that electron movement will be in the MCP 22 when it operates in an $I^2T$. Because of the differential voltage applied to the MCP 22 during application of the electron flux 104*a*, a gain initially may be experienced across the MCP 22, and a great shower of electrons may issue from the MCP 22 (indicated by the reference numeral and arrow 104*b* seen in both FIGs 3 and 3*a*, although it will be understood with reference to FIG. 3*a* that this electron bombardment and resulting electron flux 104*b*occurs before the PC assembly 52 is positioned over the other components of the $I^2T$. The flux 104*b* occurs at the output side of the MCP 22, as is indicated.

The electron flux 104*a* and the great shower of electrons 104*b* produced in MCP 22 is effective to substantially remove indigenous gas atoms from the MCP 22. Electron flux through the MCP 22 need not be reversed with respect to the direction of the electron flux that will apply in the MCP 22 in operation of the image intensifier tube 14. That is, in order to thoroughly and satisfactorily clean indigenous gas from this MCP a unidirectional flow of electrons is believed to be sufficient. This electron flux results in illumination of the screen 26, which may be viewed via port 88*b*.

Preferably, the combination of vacuum bake temperature, time, applied voltage to the MCP 22, and level of electron flux 104*a* are adjusted as necessary in order to achieve a desirably low level of indigenous gas molecules in the MCP 22 before the body 50 of the tube 14 is sealingly closed as described above. A measure of the desirably low level of indigenous gas molecules achieved in an inventive $I^2T$ according to the present invention is provided by the service life of the finished $I^2T$'s (which have no ion barrier film on their MCP's). Preferably, the inventive $I^2T$ 14 provides a service life of from as much as 400 to about 2000 hours or more while operating at applied voltage levels which provide a normal level of electric field between the PC and MCP (i.e., a field of about 1.6 to 4.0 volts per $\mu$ meter of gap dimension).

Restated, the processed MCP 22 of the $1^2T$ 14 will, during operation of the tube 14 at applied voltages between the PC and MCP providing a normal applied electric field level, will perform its function of electron amplification without significant positive ion generation, and will do so without neutral atom or ion poisoning of the PC 20. This combination of operational factors provides an acceptably long service life for the $I^2T$ 14, and the long service life of the tube can be taken as an indication of the desirably low level of indigenous gas atoms in the tube 14. This long service life is achieved by the present invention despite the fact that no ion barrier film is utilized on the MCP 22.

As pointed out above, the glasses disclosed in the two patents owned by Circon Corporation are examples of glasses which may be utilized in practicing the present invention. Heretofore, however, there has been no teaching or suggestion in the pertinent art of how to process such glasses (or any other glasses, for that matter) at the exceedingly high e-beam scrub current levels that are set out here. The present invention is, however, not limited to use of these glasses. One characteristic of these glasses which permits the present inventive process to be carried out without destroying the MCP 22 is believed to be the increased temperature tolerance of the Circon glasses. A softening temperature increase of at least about 100° C. above the softening temperature of the conventional 8161 glass is believed to be one factor allowing the present aggressive vacuum bake and e-beam scrub process to be carried out without destroying the MCP 22. This softening temperature for the preferred cladding glass is substantially 600° C. Other glasses which have a similar of higher degree of softening temperature increase over conventional 8161 glass might also be processes successfully in accord with the present invention.

Those skilled in the art will appreciate that the embodiment of the present invention depicted and described herein and above is not exhaustive of the invention. For example, glasses other than those of Circon Corporation may be found acceptable for practice of this invention. Those skilled in the art will further appreciate that the present invention may be embodied in other specific forms without departing from the spirit or central attributes thereof. Because the foregoing description of the present invention discloses only an exemplary embodiment thereof, it is to be understood that other variations are recognized as being within the scope of the present invention. Accordingly, the present invention is not limited to the particular embodiment which has been described in detail herein. Rather, reference should be made to the appended claims to define the scope and content of the present invention.

I claim:

1. An image intensifier tube comprising: a tube body bounding an evacuated chamber therein, a photocathode disposed within said evacuated chamber, and a microchannel plate disposed in said evacuated chamber and juxtaposed in spaced relation away from said photocathode to define a gap dimension therewith, said microchannel plate having a great multitude of microchannels opening therethrough to define both an electron input face and an electron output face for the microchannel plate, said multitude of microchannels opening without obstruction on said electron input face, and said gap dimension being in the range from about 125$\mu$ meter and less.

2. The image intensifier tube of claim 1 wherein said gap dimension is in the range from about 50$\mu$ meter and less.

3. The image intensifier tube of claim 1 wherein said gap dimension is in the range from about 25$\mu$ meter to about 15$\mu$ meter.

4. The image intensifier tube of claim 1 further including a power supply applying an electric field between said photocathode and said microchannel plate, where said electric field is of about 1.6 to 4.0 volts per $\mu$meter.

5. A night vision device comprising: an objective lens receiving light from a scene being viewed and directing this light to an image intensifier tube; said image intensifier tube in response to said light and the application of electrical power providing a visible image of the scene; and an eyepiece lens providing this visible image to a user of the night vision device; said night vision device including a power supply supplying said electrical power to said image intensifier tube; said image intensifier tube having a chambered evacuated housing and including in the evacuated chamber of this housing a photocathode receiving photons from the scene and responsively releasing photoelectrons in a pattern replicating the scene, a microchannel plate in spaced apart juxtaposed relation with the photocathode and having microchannels opening in the direction of the photocathode to receive the photoelectrons, said microchannel plate responsively providing a shower of secondary emission electrons in a pattern replicating the scene, and a screen receiving the shower of secondary emission electrons and producing a visible image replicating the scene; the chamber of the image intensifier tube housing having a level of indigenous gas molecules which are capable of becoming positive ions during operation of the image intensifier tube; and said microchannel plate having been scrubbed at low pressure at an applied voltage lower than that necessary to produce self-sustaining ion regeneration with an electron beam intensity sufficient to reduce said indigenous population of gaseous molecules to a level which provides at least 400 hours of operation for said image intensifier tube without substantial poisoning of said photocathode by positive ions produced from said indigenous population of gas molecules.

6. The night vision device of claim 5 wherein said photocathode and said microchannel plate cooperatively define a gap dimension, said gap dimension being in the range from about 125$\mu$ meter and less.

7. The night vision device of claim 6 wherein said gap dimension is in the range from about 25$\mu$ meter to about 15$\mu$ meter.

8. The night vision device of claim 5 wherein said power supply supplies an electric field applied between said photocathode and said microchannel plate and in which said electric field has a strength of about 1.6 to 4.0 volts per $\mu$meter.

9. A method of making an image intensifier tube, said method comprising steps of:

providing a microchannel plate;

disposing said microchannel plate in a vacuum bake environment which exposes the microchannel plate to deep vacuum;

scrubbing said microchannel plate with an electron beam generating an electron flux in the range of from about 25$\mu$ amp/cm$^2$ to as much as about 300$\mu$ amp/cm$^2$.

10. The method of claim 9 further including the step of spacing said microchannel plate away from a photocathode in an image intensifier tube body by a gap dimension in the range of about 125$\mu$ meter and less.

11. The method of claim 10 further including the step of configuring said gap dimension to be in the range of from about 25$\mu$ meter to about 15$\mu$ meter.

12. The method of claim 10 further including the step of making said microchannel plate of a cladding glass.

13. An image intensifier tube having a chambered tube body; a photocathode disposed within said chambered tube body, and a microchannel plate disposed also within said chambered tube body and in spaced apart substantially parallel juxtaposed relationship to said photocathode to define a gap dimension therewith; said microchannel plate having an electron input face and including a great multitude of microchannels opening on said electron input face and on an opposite electron discharge face thereof, and said electron input face being free of an ion barrier film so that said microchannels open on said electron input face without obstruction; said gap dimension being in the range of about 125$\mu$ meter and less.

14. The image intensifier tube of claim 13 wherein an electric field is applied between said photocathode and said microchannel plate, said electric field being in the range of from about 1.6 volt/$\mu$meter to about 4.0 volt/$\mu$meter.

15. A night vision device having an objective lens receiving light from a scene and directing this light to an image intensifier tube; a power supply supplying operating electrical power to said image intensifier tube; said image intensifier tube responsively providing a visible image; and an eyepiece lens providing said visible image to a user of the night vision device; said image intensifier tube having a tube body bounding an evacuated chamber therein; a photocathode disposed within said evacuated chamber; and a microchannel plate disposed in said evacuated chamber and juxtaposed in spaced relation away from said photocathode to define a gap dimension therewith; said microchannel plate having a great multitude of microchannels opening therethrough to define both an electron input face and an electron output face for the microchannel plate; said multitude of microchannels opening on said electron input face without obstruction and free of an ion barrier film; and said gap dimension being in the range from about 125$\mu$ meter and less.

16. The night vision device of claim 15 wherein said gap dimension is in the range from about 50$\mu$ meter and less.

17. The night vision device of claim 16 wherein said gap dimension is in the range from about 25$\mu$ meter to about 15$\mu$ meter.

18. The night vision device of claim 15 wherein said power supply applies an electric field between said photocathode and said microchannel plate of about 1.6 to 4.0 volts per $\mu$meter.

19. A night vision device having an objective lens directing light from a scene to an image intensifier tube, said image intensifier tube responsively providing a visible image, and an eyepiece lens projecting the visible image to a user of the device, said image intensifier tube composing:

a tube body defining an evacuated chamber therein;

a photocathode disposed in said chamber and receiving light from the scene to responsively liberate photoelectrons in a pattern replicating the scene;

a microchannel plate receiving said photoelectrons and responsively providing a shower of secondary-emission electrons in a pattern replicating the scene, said microchannel plate having an indigenous population of gas molecules;

a screen electrode receiving said shower of secondary emission electrons and responsively providing a visible image replicating the scene;

said microchannel plate having been scrubbed at low pressure at an applied voltage lower than that necessary to produce self-sustaining ion regeneration with an electron beam intensity sufficient to reduce said indigenous population of gaseous molecules to a level which provides at least 400 hours of operation for said image intensifier tube without substantial poisoning of said photocathode by positive ions produced from said indigenous population of gas molecules.

20. An image intensifier tube comprising:

a tube body defining an evacuated chamber therein;

a photocathode disposed in said chamber and receiving light from the scene to responsively liberate photoelectrons in a pattern replicating the scene;

a microchannel plate spaced from said photocathode to mutually define a gap therebetween and receiving said photoelectrons to responsively providing a shower of secondary-emission electrons in a pattern replicating the scene, said microchannel plate and said photocathode mutually defining a gap dimension in the range from about 125$\mu$ meter to substantially zero gap.

21. A method of providing an image intensifier tube, said method comprising steps of:

providing a tube body defining an evacuated chamber therein;

disposing a photocathode in said chamber to receive light and responsively liberate photoelectrons in a pattern replicating a scene;

disposing a microchannel plate to receive said photoelectrons and responsively provide a shower of secondary-emission electrons in a pattern replicating the scene;

removing indigenous gas molecules from said microchannel plate at low pressure utilizing an applied voltage with an electron beam intensity sufficient to reduce a population of said indigenous gas molecules so that said microchannel plate has the indigenous population of gas molecules allowing at least 400 hours of direct-current operation of the image intensifier tube with no ion barrier film between said photocathode and said microchannel plate;

providing a screen electrode receiving said shower of secondary emission electrons and responsively providing a visible image replicating the scene.

22. The method of claim 21 wherein said step of removing indigenous gas molecules from said microchannel plate includes the step of scrubbing said microchannel plate under vacuum at an applied voltage across the microchannel plate which is lower than that necessary to produce self-sustaining ion regeneration, and with a scrubbing electron beam intensity of at least $25\mu$ amp/cm$^2$.

23. The method of claim 22 wherein said step of removing indigenous gas molecules from said microchannel plate includes the step of scrubbing said microchannel plate under vacuum at an applied voltage across the microchannel plate which is lower than that necessary to produce self-sustaining ion regeneration, and with a scrubbing electron beam intensity of at least $75\mu$ amp/cm$^2$.

24. The method of claim 23 wherein said step of removing indigenous gas molecules from said microchannel plate includes the step of scrubbing said microchannel plate under vacuum at an applied voltage across the microchannel plate which is lower than that necessary to produce self-sustaining ion regeneration, and with a scrubbing electron beam intensity of at least $200\mu$ amp/cm$^2$.

25. The method of claim 24 wherein said step of removing indigenous gas molecules from said microchannel plate includes the step of scrubbing said microchannel plate under vacuum at an applied voltage across the microchannel plate which is lower than that necessary to produce self-sustaining ion regeneration, and with a scrubbing electron beam intensity of about $300\mu$ amp/cm$^2$ and higher.

26. An image intensifier tube comprising: a tube body bounding an evacuated chamber therein, a photocathode disposed within said evacuated chamber, and a microchannel plate disposed in said evacuated chamber and juxtaposed in spaced relation away from said photocathode to define a gap dimension therewith, said microchannel plate having a great multitude of microchannels opening therethrough to define both an electron input face and an electron output face for the microchannel plate, said multitude of microchannels opening without obstruction on said electron input face, said gap dimension being in the range from about $125\mu$ meter to about $15\mu$ meter, and said microchannel plate having an indigenous population of gas molecules the low level of which is indicated by said microchannel plate having been scrubbed under vacuum and at a scrubbing electron beam intensity of at least $25\mu$ amp/cm$^2$.

* * * * *